United States Patent [19]

Cox et al.

[11] 4,226,644

[45] Oct. 7, 1980

[54] HIGH GAMMA PRIME SUPERALLOYS BY POWDER METALLURGY

[75] Inventors: Arthur R. Cox, Jupiter; Romeo G. Bourdeau, Tequesta; Paul R. Holiday, Palm Beach Gardens, all of Fla.

[73] Assignee: United Technologies Corporation, Hartford, Conn.

[21] Appl. No.: 939,571

[22] Filed: Sep. 5, 1978

[51] Int. Cl.[2] ..... C22F 1/10

[52] U.S. Cl. ..... 148/2; 75/0.5 C; 75/171; 148/11.5 N; 148/11.5 P; 148/12.7 N; 148/32.5

[58] Field of Search ..... 148/32, 32.5, 2, 11.5 N, 148/11.5 P, 12.7 N; 75/171, 170, 0.5 C

[56] References Cited

U.S. PATENT DOCUMENTS 3,832,167 8/1974 Shaw et al. ..... 148/32.5

*Primary Examiner*—R. Dean

*Attorney, Agent, or Firm*—Charles E. Sohl

[57] ABSTRACT

A series of superalloy compositions are described, which when processed according to a described processing sequence, produce homogeneous superalloy articles which contain an exceptionally high amount of the gamma prime phase. These alloys contain large amounts of aluminum and chromium and hence are quite oxidation resistant. The processing sequence includes rapid solidification to suppress the formation of the low melting eutectic phases which would otherwise occur.

10 Claims, 2 Drawing Figures

HIGH GAMMA PRIME SUPERALLOYS BY POWDER METALLURGY

The invention described herein was made in the course of a contract with the Defense Advanced Research Projects Agency of the U.S. Government.

BACKGROUND OF THE INVENTION

1. Field of the Invention

The invention relates to superalloy articles and methods for producing superalloy articles.

2. Description of the Prior Art

Nickel base superalloys have been widely developed in the last 40 years, and an extensive amount of literature exists describing such alloys. The book "The Superalloys," edited by Sims and Hazel, published by Wiley in 1972 summarizes the field.

The conventional nickel base superalloys are based on nickel with additions of aluminum and other elements to form a gamma prime strengthening phase. The microstructure of nickel base superalloys consists of a gamma matrix (a nickel solid solution) containing from about 15 to about 60 volume percent of the gamma prime phase. (The gamma prime phase is an ordered compound based on $Ni_3Al$). Numerous alloy additions may be made to the basic alloy for a variety of reasons. Titanium is often added and acts interchangeably with the aluminum as a gamma prime former. Chromium is commonly added to improve oxidation resistance. Refractory metals such as molybdenum, tungsten, tantalum and columbium may be added for solid solution strengthening. Cobalt is often added to control the gamma prime solvus temperature and improve the hot workability.

There is a general correlation between strength and gamma prime content, the high gamma prime alloys have the best mechanical properties. The truly high strength superalloys are commonly used in the cast state since their high strength does not permit them to be formed except by casting.

SUMMARY OF THE INVENTION

Superalloy articles and methods of fabricating the same are described. Alloy compositions containing about 8% Al, 10% Cr, 0.1% C, 5–10% refractory metal, balance nickel with minor additions of C, B, Zr and Y are employed. These compositions form undesirable phases if processed conventionally. A processing scheme involving cooling from the molten state at a rate in excess of $10^4$° F./sec followed by directional recrystallization is employed to avoid the undesirable phases.

It is an object of the invention to produce a homogeneous alloy article containing a large amount of the gamma prime phase which has a high gamma prime solvus temperature and a high incipient melting temperature.

It is a further object to produce an oxidation resistant alloy article which has good mechanical properties at elevated temperatures. Yet another object is the production of cobalt free alloy articles having a high aluminum and chromium content.

DESCRIPTION OF PREFERRED EMBODIMENTS

Figure 1:
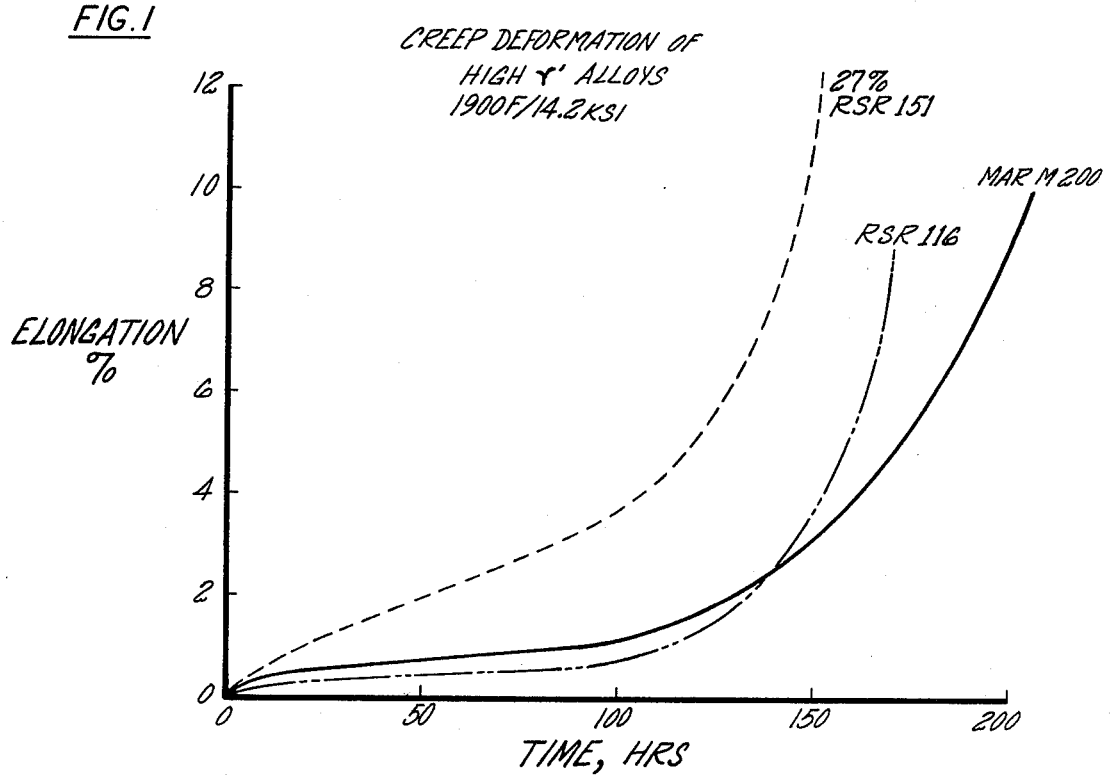
FIG. 1 shows the creep behavior or alloy articles produced according to the invention.

The invention relates to alloy articles produced from a specific alloy by a specific process.

1. The Alloy

The alloy of the present invention differs from conventional superalloys in several respects. Its aluminum content and chromium content are higher than conventional superalloys and it is free from intentional additions of cobalt. The high aluminum content promotes a high volume fraction of the gamma prime strengthening phase and also provides oxidation resistance while the high chromium content also improves oxidation resistance. Additions of refractory metals such as hafnium, tantalum, columbium and tungsten may be provided for solid solution strengthening. Carbon, zirconium, boron and yttrium may be added for improvements in grain boundary properties. The broad and preferred composition ranges of the present alloy are presented in Table I. It should be noted that the alloys are cobalt free and this is a decided advantage in view of the strategic nature of cobalt.

The alloy ranges described in Table I will result in alloys containing more than about 65% gamma prime. The ranges in Table I will produce alloys have gamma prime in the range from about 65% to about 85 or 90%. The exact gamma prime content is somewhat dependent on processing history.

TABLE I

| ELEMENT | BROAD RANGE (Wt. %) | PREFERRED RANGE (Wt. %) |
|---|---|---|
| Al | 7–12 | 7–10 |
| Ti | 0–5 | 0–2 |
| (2 Al + Ti) | 14–25 | 15–19 |
| Cr | 7–15 | 8–12 |
| Ta | 0–6 | 0–6 |
| Cb | 0–6 | 0–6 |
| W | 0–12 | 0–12 |
| Mo | 0–10 | 0–10 |
| Hf | 0–5 | 0–3 |
| (Ta + Cb + W + Mo + Hf) | 2–18 | 5–15 |
| C | 0–.5 | 0–.5 |
| B | 0–.1 | 0–.1 |
| Zr | 0–.1 | 0–.1 |
| Y | 0–.5 | 0–.5 |

When such aluminum rich high gamma prime alloys are conventionally processed, low melting eutectic phases which are rich in aluminum are formed. These phases are deleterious to the elevated temperature mechanical properties. Eutectic phase formation is the reason that such high aluminum alloy have not been previously exploited. It has been found that such phases can be suppressed by rapid cooling through the solidification temperature. This suppresses eutectic formation and generally promotes homogeneity. A preferred process is described below.

2. The Process

Although alternatives will be described below, it is preferred that the alloy of the invention be prepared by a powder metallurgy process which produces a high cooling rate, preferably a cooling rate in excess of about $10^4$° F./sec. Alloys having an exceptionally high aluminum content may require an even more rapid cooling rate.

While several processes may be used to produce such rapid cooling rates, the only process now known which can produce commercial quantities of such rapidly cooled powder is the process described in U.S. Pat. Nos. 4,025,249, 4,053,264 and 4,078,873 which are incorporated herein by reference.

Briefly, this process is one of centrifugal atomization in which the molten alloy is poured on a rapidly rotating disk and thrown outwards through a flowing gaseous cooling media. The process parameters may be controlled to produce cooling rates in excess of $10^{6°}$ F./sec.

Alternative methods for rapidly cooling liquid metal exist and are shown in U.S. Pat. Nos. 3,845,805, 3,856,074, 3,862,658, 3,881,540 and 3,881,541. These methods appear to be potential alternatives although they produce metal filaments which may be more difficult to compact than metal powder. The term particulate will be used herein to denote both powder and filaments.

By providing a rapid cooling rate the formation of aluminum rich eutectic phases will be essentially avoided. By eliminating these phases, two desirable effects are observed. First, the incipient melting point of the alloy is significantly increased thus improving the high temperature properties of the alloy and providing unique heat treatment possibilities which would not otherwise be available; and second, by distributing the aluminum uniformly throughout the alloy, an increased volume fraction of the strengthening gamma prime phase will be obtained as compared with that volume fraction obtained in a nonhomogeneous alloy condition, additionally the improved aluminum distribution is believed to aid in oxidation resistance of the alloy.

An increase in aluminum content will provide both an increase in the gamma prime phase and an increase in the likelihood of eutectic formation for a given set of processing conditions. For conventional castings of moderate size solidified at a cooling rate of about order of $10^{1°}$ to $10^{2°}$ F./sec, essentially no eutectic is observed in alloys which contain about 25% of the gamma prime phase (alloys such as Waspaloy). Under the same cooling conditions, aluminum rich eutectic phases will form in alloys containing about 40% gamma prime (alloys such as UDIMET 500). For the same 40% gamma prime alloy an increase in the cooling rate to $10^{3°}$ F./sec, as might be observed in a conventional powder production process, will essentially suppress the formation of aluminum rich eutectic phases.

A further increase in aluminum content sufficient to produce a gamma prime content of about 65% (alloys such as In 100 and MAR M-200) results in an alloy which will show eutectic phases even when cooled at $10^{3°}$ F./sec. An increase in the cooling rate to between $10^{4°}$ and $10^{5°}$ F./sec has been experimentally observed to effectively suppress eutectic formation even in alloys containing up to 78% gamma prime. Conventional powder atomization techniques usually provide cooling rates of about $10^{3°}$ F./sec or less.

The cooling rate required to suppress the eutectic is related to the alloy composition. Aluminum contents on the low end of the range which will produce gamma prime contents on the order of 65–70% may be successfully processed by cooling rates as low as about $10^4$. Higher aluminum contents (higher gamma prime alloys) will require higher cooling rates. It is anticipated that the 85–90% gamma prime alloys may require cooling rates of about $10^6$ if eutectic formation is to be avoided. Of course, there is no problem in using a faster cooling rate than that required for a particular alloy. Since the eutectic phase forms only during the liquid to solid transformation, if the eutectic phase can be avoided during the initial solidification, it will not be a problem during subsequent processing so long as the material is not remelted.

The particulate thus prepared must then be compacted or otherwise consolidated. To ensure interparticle bonding it is preferred that the alloys not be exposed to an oxidizing atmosphere, since any surface oxide film surface will interfere with bonding. The consolidation process is preferably carried out at elevated temperatures and may be performed by hot extrusion and other similar processes. A typical set of extrusion conditions would be a reduction ratio of about 4:1 and an extrusion temperature of about 2000° F. Of course, other compaction processes such as Hot Isostatic Pressing or explosive compaction may be used to produce consolidated material.

While material produced by consolidating the previously described powder material may have utility for certain applications, it is desirable and highly preferred to produce an oriented microstructure by a directional recrystallization process. Such a process involves the passage of the article through a thermal gradient. The hot end of the thermal gradient is maintained at a temperature in excess of the gamma prime solvus temperature of the alloy but less than incipient melting temperature of the alloy. The alloy is preferably preconditioned to make it particularly susceptible to directional recrystallization.

The pretreatment step is selected to produce an effective dispersion of gamma prime particles which serve to prevent significant grain growth. It is known in the prior art to prepare alloys for directional recrystallization by imparting a critical amount of strain energy into the alloy. This has not been found to be necessary when the alloy is preconditioned as previously described.

When the alloy is passed through the thermal gradient, the gamma prime particles dissolve thus permitting grain growth. Grain growth occurs with the major driving force being the reduction in grain boundary area and the resultant grains are elongated and have a major axis which is parallel to the direction of motion of the thermal gradient. In producing a particular part, the conditions are arranged such that the direction of grain elongation is parallel to the major stress axis of a part so that the amount of grain boundary area transverse to the stress axis is minimized. The elongated grains typically have an aspect ratio, the ratio of the major axis to the minor axis, in excess of 10:1 and usually much greater.

The preferred preconditioning step consists of an annealing step below the gamma prime solvus but very close to the gamma prime solvus. This step is preferably carried out within about 200° F. of the gamma prime solvus and most preferably within 50° F. of the gamma prime solvus. The annealing step must be performed for a time sufficient to cause the formation of gamma prime at the grain boundaries, and this may be readily determined by simple experimentation. Times of 4 hours have proven to be adequate but shorter times may be sufficient and there does not appear to be a significant detriment in the use of longer times except for the obvious cost penalties.

Following the directional grain growth step, the articles are preferably heat treated at a temperature above the gamma prime solvus temperature (but below the melting point) to dissolve all the gamma prime phase and then held at a lower temperature to precipitate a maximum amount of refined gamma prime particles. Typically, the gamma prime solvus temperature of these alloys will range from 2250° F. to 2400° F. and the aging temperature will range from 1600° F. to 2000° F. The melting temperature of the alloys must always exceed the gamma prime solvus temperature typically by at least 50° F. so as to provide a useful temperature range for heat treatments. The present invention may be better understood by reference to the following examples which are intended to be illustrative rather than limiting.

EXAMPLE I

Samples of three commercially used alloys, IN 100, MAR M-200 and AF2-1DA were prepared in conventionally cast form and by the process of the invention involving solidification at about $10^4$° F./sec, compaction and directional recrystallization.

The nominal composition of these alloys is given in Table II. These alloys do not fall within the scope of the present invention, however, they are typical of the best commercially available superalloys currently in use and have gamma prime contents of 60–65%. The incipient melting temperature and gamma prime solvus temperature of the alloys were then determined and are presented in Table II.

It can be seen from Table I that alloys produced according to the process of the invention have a significant increase in incipient melting temperature as a consequence of the suppression of the low melting phases, and the increased homogeneity. This is desirable since it provides a wider range of temperatures between the gamma prime solvus temperature and the melting temperatures thus giving a wider temperature range for solution treatment. The increased melting temperature has another related benefit in that solution treatment at a higher temperature will permit the use of shorter heat treatment periods.

EXAMPLE II

A series of alloys of compositions falling within the intended scope of the invention were prepared by powder metallurgy techniques including cooling from molten state at a rate in excess of $10^4$° to $10^5$° F./sec, consolidation by hot extrusion at 2100° F. and directionally recrystallized. The alloy compositions, gamma prime contents, gamma prime solvus temperatures and incipient melting temperatures are shown in Table III.

These alloys were tested for cyclic oxidation at 2100° F. and creep deformation at 1900° F./14.2 KSI. The oxidation results are shown in FIG. 1 and are compared with the oxidation results of directionally solidified MAR M-200, a widely used conventional superalloy. It can be seen that the alloys of the present invention processed accordingly to the present invention have dramatically improved oxidation resistance.

Figure 2:
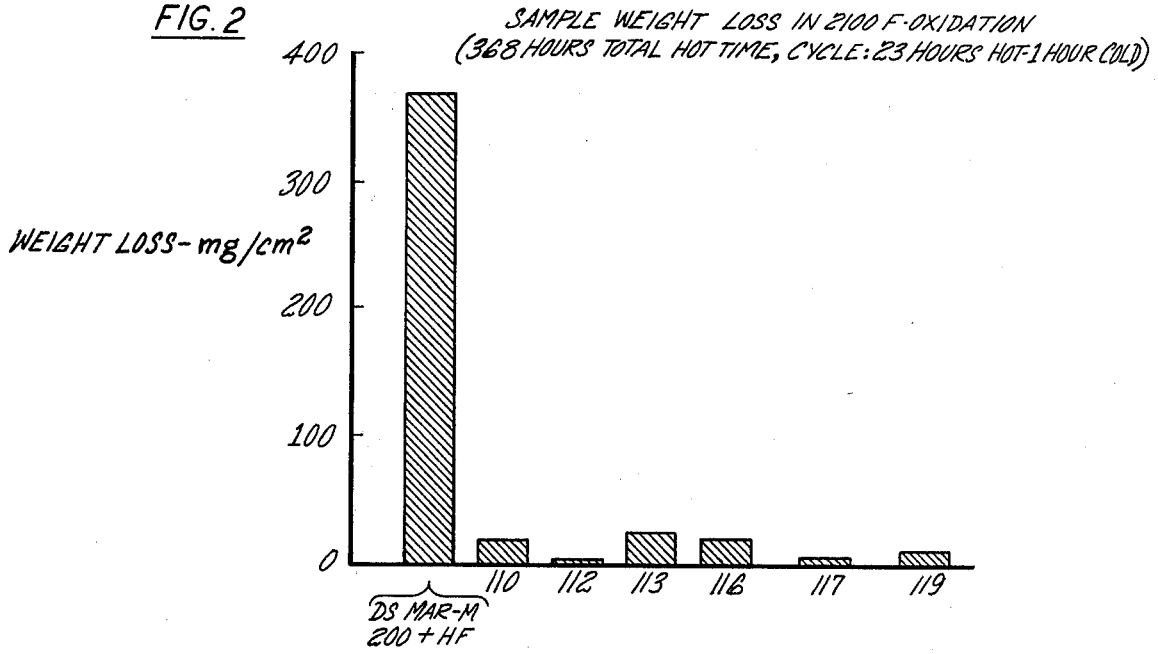
FIG. 2 shows the oxidation behavior of alloy articles produced according to the invention.

The creep property at 1900° F. and an applied load of 14.2 KSI are shown in FIG. 2 along with comparable data from directionally solidified MAR M-200. On this figure, it can been seen that the invention alloys approach the creep properties of the conventional alloy. These results show that alloys fabricated according to the present invention have a vastly superior oxidation resistance and creep properties which are comparable to that of conventional superalloys. These results indicate that the invention alloys would be useful in gas turbine engines especially in vane application where oxidation resistance is crucial and mechanical loading is not excessive.

Articles produced according to the present invention have an exceptionally high gamma prime solvus temperature. This is a distinct advantage in that it leads to increased thermal stability of the gamma prime phase at elevated temperatures. Thus, in conventional superalloys having a 2150° F. gamma prime solvus, the gamma prime phase is observed to be unstable at temperatures of about 2100° F. and above, especially when stressed at these temperatures. The invention alloy articles with a typical gamma prime solvus at 2350° F. will have greatly superior long term stability at 2100° F. than will conventional alloys. Thus, the present invention alloys offer the promise of superior long term performance in applications where elevated temperatures are encountered, especially turbine engine vanes where temporary localized overheating may be a problem.

The invention alloys are particularly compatible with most of the coating currently used in gas turbine engines. Such protective coats rely on the formation of an aluminum layer and hence are rich in aluminum. The high aluminum content of the invention alloys will tend to reduce the rate at which aluminum diffuses from the coating into the substrate.

The previously described processing sequence employs rapid solidification to ensure compositional homogeneity. It is anticipated that the same result could be achieved by a heat treatment step. Such a step would be

TABLE II

| | Wt. % | | | | | | | | | | | | | |
|---|---|---|---|---|---|---|---|---|---|---|---|---|---|---|
| | Al | Ti | Cr | Co | Mo | W | Cb | C | B | Zr | V | M.P.* | M.P.** | γ' Solvus |
| IN 100 | 5.5 | 4.7 | 10.0 | 15.0 | 3.0 | — | — | .18 | .014 | .06 | 1.0 | 2190 | 2320 | 2100 |
| MAR M-200 | 5.0 | 2.0 | 9.0 | 10.0 | — | 12.5 | 1.0 | .15 | .015 | .05 | — | 2240 | 2360 | 2190 |
| AF2-1DA | 4.6 | 3.0 | 12.0 | 10.0 | 3.0 | 6.0 | — | .35 | .015 | .1 | — | 2180 | 2350 | 2725 |

*Conventional Process
**Invention Process

TABLE III

| Alloy | Al | Ti | Cr | Ta | Cb | W | C | B | Zr | % γ' | γ' Solvus | M.P. |
|---|---|---|---|---|---|---|---|---|---|---|---|---|
| 110 | 8.5 | 1.1 | 9.3 | — | — | 6.6 | .21 | — | — | 78 | 2350 | 2450 |
| 112 | 8.9 | 1.1 | 9.8 | — | — | — | .21 | — | — | 76 | 2340 | 2440 |
| 113 | 7.7 | 2.0 | 9.7 | — | 1.7 | — | .21 | — | — | 72 | 2320 | 2420 |
| 116 | 8.3 | — | 9.2 | — | — | 9.4 | .05 | — | — | 73 | 2340 | 2465 |
| 117 | 8.3 | — | 9.9 | — | — | 9.3 | .20 | — | — | 73 | 2340 | 2430 |
| 119 | 7.7 | .9 | 9.7 | — | 3.0 | — | .19 | — | — | 66 | 2330 | 2420 |
| 151 | 8.0 | — | 8.5 | 3.0 | — | 6.0 | .20 | .005 | .04 | 70 | 2385 | 2420 |

performed at a temperature below, but very close to the incipient melting temperature for a period of time sufficient to permit homogenization to occur. This type of process is described in U.S. Pat. No. 3,753,790 which is incorporated herein by reference. It is also possible to combine these two types of processes. If a rapidly cooled material contains some of the low melting eutectic phase, a heat treatment step such as that described above could be employed for homogenization.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. A method of fabricating an oxidation resistant nickel superalloy article including the steps of:

a. providing an alloy consisting of 7–12% Al, 0–5% Ti, 7–15% Cr, 0–6% Ta, 0–6% Cb, 0–12% W, 0–10% Mo, 0–5% Hf, 0–0.5% C, 0–0.1% B, 0–0.1% Zr, 0–0.5% Y, balance nickel;

b. melting the alloy;

c. solidifying the alloy into particulate form at a rate in excess of $10^4$° F./sec. which is sufficient to suppress the formation of low melting eutectic phases; and d. compacting the solidified particulate form an article; and whereby the incipient melting temperature of the alloys and the elevated temperature mechanical properties of the alloy are increased and so that a more uniform distribution of elements throughout the alloy as obtained resulting in an increased volume fraction of the gamma prime phase being present and in improved oxidation resistance.

2. A method as in claim 1 wherein the article formed in heat treated near, but below the gamma prime solvus temperature to cause the formation of gamma prime particles at grain boundaries and is then passed through a thermal gradient whose hot end is greater than the gamma prime solvus temperature, but less than the incipient melting temperature to form elongated grains.

3. A method as in claim 2 wherein after the passage of the article through the thermal gradient, the article is reheated to a temperature in excess of the gamma prime solvus temperature, but below the incipient melting temperature, to dissolve substantially all of the gamma prime, and is then held at a temperature below the gamma prime temperature to cause controlled reprecipitation of the gamma prime phase.

4. A method as in claim 1 wherein the alloy consists essentially of 7–10% Al, 0–2% Ti, 8–12% Cr, 0–6% Ta, 0–6% Cb, 0–12% W, 0–10% Mo, 0–3% Hf, 0–0.5% C, 0–0.1% B, 0–1% Zr, 0–0.5% Y, balance nickel.

5. A method as in claim 2 wherein the sum of Ta+Cb+W+Mo+Hf is about 2–18%.

6. A method as in claim 2 wherein the sum of Ta+Cb+W+Mo+Hf is about 5–15%.

7. The product made according to the method of claim 1.

8. The product made according to the method of claim 2.

9. The product made according to the method of claim 3.

10. The product made according to the method of claim 4.

* * * * *